US007145139B2

(12) United States Patent
Syka

(10) Patent No.: US 7,145,139 B2
(45) Date of Patent: Dec. 5, 2006

(54) CONFINING POSITIVE AND NEGATIVE IONS WITH FAST OSCILLATING ELECTRIC POTENTIALS

(75) Inventor: John E. P. Syka, Charlottesville, VA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 11/394,504

(22) Filed: Mar. 31, 2006

(65) Prior Publication Data

US 2006/0169884 A1 Aug. 3, 2006

Related U.S. Application Data

(63) Continuation of application No. 10/764,435, filed on Jan. 23, 2004, now Pat. No. 7,026,613.

(51) Int. Cl.
*H01J 49/42* (2006.01)

(52) U.S. Cl. ..... 250/292; 250/282

(58) Field of Classification Search ..... None
See application file for complete search history.

(56) References Cited

U.S. PATENT DOCUMENTS 4,755,670 A 7/1988 Syka et al.
4,982,087 A 1/1991 Allemann et al.
5,206,506 A 4/1993 Kirchner
7,026,613 B1 * 4/2006 Syka ..... 250/292
2003/0183759 A1 10/2003 Schwartz et al.
2005/0263697 A1 * 12/2005 Hager et al. ..... 250/292
2005/0279931 A1 * 12/2005 Franzen et al. ..... 250/290

FOREIGN PATENT DOCUMENTS

GB 2378312 A 2/2003

* cited by examiner

*Primary Examiner*—Jack I. Berman
(74) *Attorney, Agent, or Firm*—Charles B. Katz

(57) ABSTRACT

Methods and apparatus for trapping or guiding ions. Ions are introduced into an ion trap or ion guide. The ion trap or ion guide includes a first set of electrodes and a second set of electrodes. The first set of electrodes defines a first portion of an ion channel to trap or guide the introduced ions. Periodic voltages are applied to electrodes in the first set of electrodes to generate a first oscillating electric potential that radially confines the ions in the ion channel, and periodic voltages are applied to electrodes in the second set of electrodes to generate a second oscillating electric potential that axially confines the ions in the ion channel.

20 Claims, 8 Drawing Sheets

CONFINING POSITIVE AND NEGATIVE IONS WITH FAST OSCILLATING ELECTRIC POTENTIALS

CROSS-REFERENCE TO RELATED APPLICATION

This application is a continuation of and claims priority from U.S. patent application Ser. No. 10/764,435 entitled "Confining Positive and Negative Ions with Fast Oscillating Electric Potentials" filed on Jan. 23, 2004 now U.S. Pat. No. 7,026,613.

BACKGROUND

The present invention relates to mass spectrometry.

A mass spectrometer analyzes masses of sample particles, such as atoms and molecules, and typically includes an ion source, one or more mass analyzers and one or more detectors. In the ion source, the sample particles are ionized. The sample particles can be ionized with a variety of techniques that use, for example, chemical reactions, electrostatic forces, laser beams, electron beams or other particle beams. The ions are transported to one or more mass analyzers that separate the ions based on their mass-to-charge ratios. The separation can be temporal, e.g., in a time-of-flight analyzer, spatial e.g., in a magnetic sector analyzer, or in a frequency space, e.g., in ion cyclotron resonance ("ICR") cells. The ions can also be separated according to their stability in a multipole ion trap or ion guide. The separated ions are detected by one or more detectors that provide data to construct a mass spectrum of the sample particles.

In the mass spectrometer, ions are guided, trapped or analyzed using magnetic fields or electric potentials, or a combination of magnetic fields and electric potentials. For example, magnetic fields are used in ICR cells, and multipole electric potentials are used in multipole traps such as three-dimensional ("3D") quadrupole ion traps or two-dimensional ("2D") quadrupole traps.

For example, linear 2D multipole traps can include multipole electrode assemblies, such as quadrupole, hexapole, octapole or greater electrode assemblies that include four, six, eight or more rod electrodes, respectively. The rod electrodes are arranged in the assembly about an axis to define a channel in which the ions are confined in radial directions by a 2D multipole potential that is generated by applying radio frequency ("RF") voltages to the rod electrodes. The ions are traditionally confined axially, in the direction of the channel's axis, by DC biases applied to the rod electrodes or other electrodes such as plate lens electrodes in the trap. In a portion of the channel defined by the rod electrodes, the DC biases can generate electrostatic potentials that axially confine either positive ions or negative ions, but cannot simultaneously confine both. Additional AC voltages can be applied to the rod electrodes to excite, eject, or activate some of the trapped ions.

In MS/MS experiments, selected precursor ions (also called parent ions) are first isolated or selected, and next reacted or activated to induce fragmentation to produce product ions (also called daughter ions). Mass spectra of the product ions can be measured to determine structural components of the precursor ions. Typically, the precursor ions are fragmented by collision activated dissociation ("CAD") in which the precursor ions are kinetically excited by electric fields in an ion trap that also includes a low pressure inert gas. The excited precursor ions collide with molecules of the inert gas and may fragment into product ions due to the collisions.

Product ions can also be produced by electron capture dissociation ("ECD") or ion-ion interactions. In ECD, low energy electrons are captured by multiply charged positive precursor ions, which then may undergo fragmentation due to the electron capture. To induce ECD processes in ICR cells, the precursor ions and the electrons are radially confined by large magnetic fields, typically from about three to about nine Tesla. Axially, the positive precursor ions and the electrons are confined by electrostatic potentials in adjacent regions. Near the border of the adjacent regions, trajectories of the precursor ions and the electrons may overlap and ECD may take place. Alternatively, the trapped precursor ions may be exposed to a flux of low energy electrons.

Multipole ion traps typically use RF multipole potentials to radially confine ions. An electron's mass-to-charge ratio is one hundred thousand to one million times smaller than mass-to-charge ratios of typical precursor ions. Conventional multipole traps, however, can simultaneously confine only particles whose mass-to-charge ratios do not differ more than about a few hundred times. It has been suggested that ECD can be performed in a multipole trap if additional magnetic fields are used to trap the electrons or a large flux of electrons is introduced.

Ion-ion interactions have been used to generate product ions in 3D quadrupole traps, where an oscillating 3D quadrupole potential can simultaneously confine positive and negative ions in a central volume, and no electrostatic potentials are required to provide axial confinement.

SUMMARY

In a 2D multipole ion trap or ion guide that defines an internal volume, ions are confined by oscillating electric potentials in both radial and axial directions. In general, in one aspect, the invention provides techniques for trapping or guiding ions. Ions are introduced into an ion trap or ion guide. The ion trap or ion guide includes a first set of electrodes and a second set of electrodes. The first set of electrodes defines a first portion of an ion channel to trap or guide the introduced ions. Periodic voltages are applied to electrodes in the first set of electrodes to generate a first oscillating electric potential that radially confines the ions in the ion channel, and periodic voltages are applied to electrodes in the second set of electrodes to generate a second oscillating electric potential that axially confines the ions in the ion channel.

Particular implementations can include one or more of the following features. Introducing ions can include introducing positive ions and negative ions into the ion trap or ion guide. The ion trap or ion guide can include a first end and a second end, and the positive and negative ions can be introduced at the first end and the second end, respectively. The ion trap or ion guide can include two or more sections, and one or more DC biases can be applied to one or more of the sections of the ion trap or ion guide to confine the positive or the negative ions into one or more sections. Applying periodic voltages to electrodes in the first set of electrodes can include applying periodic voltages with a first frequency, and applying periodic voltages to electrodes in the second set of electrodes can include applying periodic voltages with a second frequency that is different from the first frequency. The first and second frequencies can have a ratio that is about an integer number or a ratio of integer numbers. The first and second frequencies have a ratio of about two. The first and second oscillating electric potentials can have different spatial distributions. The ion channel can have an axis, and the first oscillating electric potential can define substantially zero electric field at the axis of the ion channel, and the second oscillating electric potential can define substantially non-zero electric field at the axis of the ion channel. The first oscillating potential can includes an oscillating quadrupole, hexapole or larger multipole potential. The second oscillating potential can include an oscillating dipole potential. The first and second oscillating electric potentials can define a pseudopotential for each particular mass and charge of the introduced ions such that each of the defined pseudopotentials specifies a corresponding potential barrier along the ion channel. The first set of electrodes can include a plurality of rod electrodes. The second set of electrodes can include a plurality of rod electrodes defining a second portion of the ion channel. The second set of electrodes can include one or more plate ion lens electrodes. The second set of electrodes can include a first plate ion lens electrode at a first end of the ion channel and a second plate ion lens electrode at a second end of the ion channel.

In general, in another aspect, the invention provides an apparatus. The apparatus includes a first set and a second set of electrodes and a controller. The first set of electrodes is arranged to define a first portion of an ion channel to trap or guide ions. The controller is configured to apply periodic voltages to electrodes in the first set and the second set to establish a first oscillating electric potential and a second oscillating electric potential, wherein the first and second oscillating electric potentials have different spatial distributions and confine ions in the ion channel in radial and axial directions, respectively.

Particular implementations can include one or more of the following features. The controller can be configured to confine simultaneously positive and negative ions in the ion channel in both radial and axial directions. The controller can be configured to apply periodic voltages to electrodes in the first set of electrodes with a first frequency, and to electrodes in the second set of electrodes with a second frequency that is different from the first frequency. The first and second frequencies can have a ratio that is about an integer number or a ratio of integer numbers. The first set of electrodes can include a plurality of rod electrodes. The second set of electrodes can include a plurality of rod electrodes defining a second portion of the ion channel, or one or more plate ion lens electrodes. The second set of electrodes can include a first plate ion lens electrode at a first end of the ion channel and a second plate ion lens electrode at a second end of the ion channel.

The invention can be implemented to provide one or more of the following advantages. Positive and negative ions can be simultaneously confined in an internal volume defined by electrode structures in a 2D multipole ion trap. Due to the simultaneous confinement in the same volume, product ions can be generated by ion-ion interactions. The 2D multipole ion trap can trap substantially more (typically, thirty to one hundred fold more) positive and negative ions than a 3D quadrupole trap. Thus, the 2D multipole trap can provide more product ions for a later analysis, which can be performed with larger signal-to-noise ratios, and low abundance product ions may also be detected. The positive and negative ions can be more conveniently introduced in a 2D multipole ion trap than into a 3D quadrupole trap. For example, the positive ions can be introduced at one end of a linear 2D multipole trap and the negative ions can be introduced at the other end. The positive ions can be precursor ions and the negative ions can be reagent ions that may induce charge transfer to or from the precursor ions. Alternatively, the positive ions can be reagent ions and the negative ions can be precursor ions. Alternatively, negative reagent ions may abstract charged species, typically one or more protons, from the precursor ion. The charge transfer can reduce a multiple charge of the precursor ion, invert the charge polarity of the precursor ion, or induce a fragmentation of the precursor ion. For precursor ions such as phosphopeptide ions, the charge transfer reaction may precipitate fragmentation that results in product ion spectra that are more informative than the product ion spectra of the same species produced with CAD alone. Such charge transfer may induce fragmentation or simply charge reduction of ions other than the precursor ions, such as fragmentation or charge reduction of the product ions produced by prior charge transfer reactions. In a linear 2D quadrupole trap or other 2D multipole rod assembly, precursor ions and reagent ions having opposite sign of charge can be trapped in the same volume both radially and axially by a superposition of RF electric potentials, without large magnetic fields. A segmented linear trap can initially store precursor ions and reagent ions in separate segments and induce fragmentation later by allowing the precursor ions and the reagent ions to interact in the same segment or segments. Before allowing their interaction, the precursor ions or the reagent ions may be manipulated in the separate segments using conventional methods, such as selecting the precursor or reagent ions by established methods of isolation. The ion-ion interactions can be stopped at any time by re-segregating the positive and negative ion populations. In a channel where an ion population includes positive ions, negative ions or both, and the ions are radially confined by electric fields defined by a primary RF potential, a secondary RF electric potential can define electric fields that selectively confine ions of the population in the axial direction of the channel based on the mass and charge of an ion, but independent of the sign of the ion's charge. Thus, axial confinement can be used as a valve or a gate that can be opened or closed to allow or block the passage of ions in the axial direction. Axial confinement can be provided by an electric potential that is generated by secondary RF voltages applied to lens end plate electrodes. In an assembly with two or more axial segments, the ions can be axially confined by applying different combination of RF voltages to multipole rods in different segments of the assembly. One or more of the segments of the assembly, can be implemented by separate 2D multipole traps. Axial confinement may also be achieved by applying secondary RF voltages to auxiliary electrodes located around, adjacent or in between the multipole rod electrodes of the multipole ion trap. Because linear ion traps are readily adapted to other mass spectrometers, after performing ion-ion reaction experiments in the linear ion traps, the product ions can be easily transported for analysis to different mass analyzers, such as TOF, FTICR or different RF ion trap mass spectrometers. Thus ion-ion experiments can use a wide range of instruments, not just 3D quadrupole ion traps.

The details of one or more embodiments of the invention are set forth in the accompanying drawings and the description below. Unless otherwise noted, the verbs "include" and "comprise" are used in an open-ended sense—that is, to indicate that the "included" or "comprised" subject matter is a part or component of a larger aggregate or group, without excluding the presence of other parts or components of the aggregate or group. The terms "front", "center", and "back," are used to denote parts of an apparatus, such as a multipole ion trap or equivalent thereof, in schematic illustrations without particular reference to the actual locations of the parts of the apparatus in any absolute sense, such as when the apparatus is inverted or rotated. Other features and advantages of the invention will become apparent from the description, the drawings and the claims.

DETAILED DESCRIPTION

Figure 1:
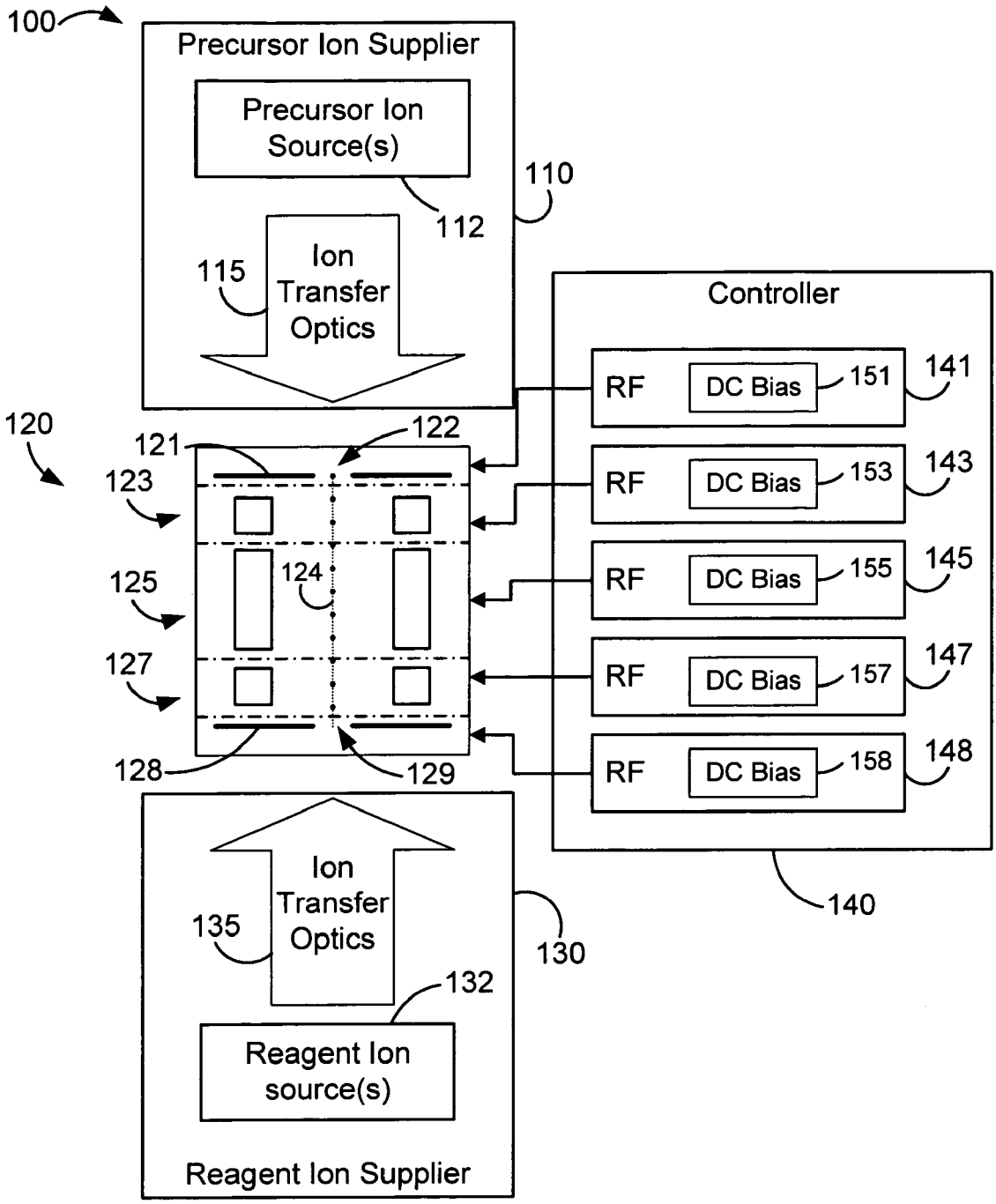
FIG. 1 is a schematic diagram illustrating apparatus for mass spectrometry according to one aspect of the invention.

FIG. 1 illustrates a mass spectrometry system 100 configured to operate according to one aspect of the invention. The system 100 includes a precursor ion supplier 110, a 2D multipole ion trap 120, a reagent ion supplier 130 and a controller 140. The precursor ion supplier 110 generates ions that include precursor ions. The ions generated by the precursor ion supplier 110 are injected into the 2D multipole ion trap 120. The reagent ion supplier 130 generates ions that include reagent ions. The ions generated by the reagent ion supplier 130 are also injected into the 2D multipole ion trap 120. The 2D multipole ion trap 120 defines a channel in which the precursor ions and the reagent ions can be confined both radially and axially by oscillating electric potentials generated by periodic voltages that are applied to different electrodes in the ion trap 120 by the controller 140.

The precursor ion supplier 110 includes one or more precursor ion sources 112 to generate precursor ions from sample molecules, such as large biological molecules, and ion transfer optics 115 to guide the generated ions from the precursor ion sources 112 to the ion trap 120. Precursor ions can be generated using electrospray ionization ("ESI"), thermospray ionization, field, plasma or laser desorption, chemical ionization or any other technique to generate precursor ions. The precursor ions can be positive or negative ions and can have single or multiple charges. For example, ESI techniques produce multiply charged ions from large molecules that have multiple ionizable sites.

The reagent ion supplier 130 includes one or more reagent ion sources 132 to generate reagent ions from sample molecules, and ion transfer optics 135 to guide the generated ions from the reagent ion sources 132 to the ion trap 120. Upon interaction, the reagent ions may induce charge transfer from the reagent ions to other ions, such as the precursor ions generated by the precursor ion supplier 110. The reagent ions can induce proton transfer or electron transfer to or from the precursor ions. For positive precursor ions, the reagent ions can include anions derived from perfluorodimethylcyclohexane (PDCH) or $SF_6$. For negative precursor ions, the reagent ions can be positive ions, such as Xenon ions. The choice of the particular reagent ions can depend on the precursor ions and/or parameters of the ion trap.

For positive precursor ions, the reagent ion sources 132 generate negative reagent ions using chemical ionization, ESI, thermospray, particle bombardment, field, plasma or laser desorption. For example in chemical ionization, negative reagent ions are generated by associative or dissociative processes in a chemical plasma that includes neutral, positively and negatively charged particles, such as ions or electrons. In the chemical plasma, low energy electrons may be captured by neutral particles to form a negative ion. The negative ion may be stable or may fragment into product ions that include negative ions. The negative reagent ions can be extracted from the chemical plasma, for example, by electrostatic fields. In alternative implementations, the reagent ion sources 132 generate the reagent ions using other techniques. For example, positive and negative ions can be generated by ESI, and the negative reagent ions can be selected using electrostatic fields.

The ion transfer optics 115 and 135 transport the ions generated by the precursor ion sources 112 and the reagent sources 132, respectively, to the multipole ion trap 120. The ion transfer optics 115 or 135 can include one or more 2D multipole rod assemblies such as quadrupole or octapole rod assemblies to confine the transported ions radially in a channel. The ions can be transported between different rod assemblies by inter-multipole lenses. The ion transfer optics 115 or 135 can be configured to transport only positive or negative ions or to select ions with particular ranges of mass-to-charge ratios. The ion transfer optics 115 or 135 can include lenses, ion tunnels, plates or rods to accelerate or decelerate the transported ions. Optionally, the ion transfer optics 115 or 135 can include ion traps to temporarily store the transported ions.

The multipole ion trap 120 includes a front plate lens 121, a back plate lens 128 and two or more sections between the lenses 121 and 128. In the implementation shown in FIG. 1, the ion trap 120 includes a front section 123, a center section 125 and a back section 127. The front lens 121 defines a front aperture 122 to receive the ions transported by the ion transfer optics 115 from the precursor ion sources 112, and the back lens 128 defines a back aperture 129 to receive the ions transported by the ion transfer optics 135 from the reagent ion sources 132. Each of the sections 123, 125 and 127 includes a corresponding 2D multipole rod assembly, such as a quadrupole rod assembly including four quadrupole rod electrodes. Each of the multipole rod assemblies defines a portion of a channel about an axis 124 of the ion trap 120. In this channel, ions can be radially and axially confined in one or more of the sections 123, 125, 127 by oscillating electric potentials generated by the voltages applied to the multipole rod electrodes and the lenses 121 and 128 of the ion trap 120. In alternative implementations, one or more of the sections 123, 125 and 127 can be implemented by separate 2D ion traps.

The controller 140 applies a corresponding set of RF voltages 143, 145 and 147 to multipole rod assemblies in the sections 123, 125 and 127, respectively, to generate oscillating 2D multipole potentials that confine ions in radial directions in the channel about the axis 124. In one implementation, the controller 140 applies a primary set of RF voltages to each of the rod assemblies in the sections 123, 125 and 127. For quadrupole assemblies with two pairs of opposing rods, the primary set of RF voltages can include a first RF voltage for the first pair of opposing rods, and a second RF voltage with the same RF frequency and opposite phase for the second pair of opposing rods. Alternatively, the controller 140 can apply RF voltages 143, 145 and 147 with different frequencies or phases to multipole rod assemblies in different sections of the ion trap.

The controller 140 can also apply RF voltages 141 and 148 to the front lens 121 and the back lens 128, respectively. The RF voltages 141 and 148 can have different frequencies or phases from the frequencies or phases of the sets of RF voltages 143 and 147 applied to the rod assemblies in the front section 123 and the end section 128, respectively. The RF voltages 141 and 148 applied to the front lens 121 and the back lens 128 generate oscillating electric potentials that can simultaneously confine positive and negative ions in the axial direction at the corresponding end of the channel about the axis 124. Axially confining ions with oscillating electric potentials is further discussed below with reference to FIGS. 2A–2D.

The controller 140 can apply different DC biases 151–158 to the lenses 121 and 128 and the rod assemblies in different sections of the ion trap 120. Depending on the sign of the DC bias applied in a section of the trap 120, positive or negative ions can be axially confined in that section. For example, positive precursor ions can be trapped in the front section 123 by applying a negative DC bias to the multipole rods in the front section 123 and substantially zero DC bias to the center section 125 and the front lens 121. Similarly, negative reagent ions can be trapped in the back section 127 by applying a positive DC bias to the multipole rods in the back section 127 and substantially zero DC bias to the center section 125 and the back lens 121. By applying different DC biases to different segments and lenses, the positive and negative ions can be received or separated in the ion trap 120, as discussed below with reference to FIGS. 4–5F. The controller 140 can also apply additional AC voltages to the electrodes in the ion trap to eject ions from the ion trap 120 based on the ions' mass-to-charge ratios.

Figure 2A:
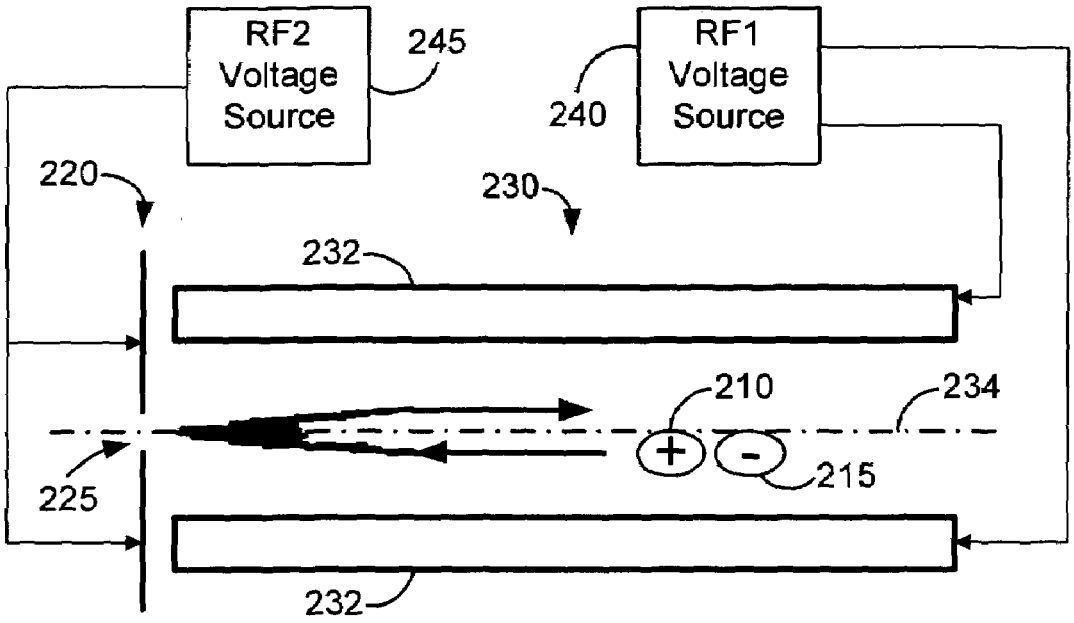
FIGS. 2A–2D are schematic diagrams illustrating axial confinement of ions with oscillating electric potentials.

FIG. 2A is a schematic illustration of confining positive ions 210 and negative ions 215 simultaneously in a 2D multipole ion trap at an end section 230 that is adjacent to an ion lens 220. For example, the end section 230 can be the front section 123 or the back section 127 of the ion trap 120 and the ion lens 220 can be the front lens 121 or the back lens 128 in the system 100 (FIG. 1).

The end section 230 includes a 2D multipole rod assembly 232 that receives RF voltages from an RF voltage source 240 to generate an oscillating 2D multipole potential to confine radially the positive 210 and negative 220 ions close to an axis 234 of the multipole ion trap. For example, the rod assembly 232 can be a quadrupole rod assembly that generates an oscillating 2D quadrupole potential about the axis 234.

The ion lens 220 receives RF voltages from the RF voltage source 245 to generate an oscillating electric potential that axially confines both the positive 210 and the negative 215 ions. That is, the axially confining potential prevents the ions 210 and 215 from escaping the end section 230 through an aperture 225 in the ion lens 220. The axially confining potential has a different spatial distribution than the multipole potential generated by the assembly 232. The multipole potential defines substantially zero electric fields at the axis 234, and the axially confining potential defines substantially non-zero electric fields at the axis 234 near the ion lens 220.

The multipole rod assembly 232 includes rod electrodes that receive RF voltages with a first frequency and the ion lens 220 receives RF voltages with a second frequency. In one implementation, the first frequency and the second frequency are related to each other by a rational number. For example, the first frequency is substantially an integer multiple or an integer fraction of the second frequency. Alternatively, the first frequency can be any other multiple or fraction of the second frequency. Or the first and second frequencies can be substantially equal, while the ion lens 220 receives an RF voltage that is out-of-phase with the RF voltages received by the rod assembly 232. Typically, the rod assembly 232 receives RF voltages with multiple phases. In a quadrupole rod assembly, neighboring rod electrodes receive voltages that are 180 degrees out of phase relative to each other. Thus, the ion lens 220 can receive an RF voltage that has about (plus or minus) ninety-degree phase difference relative to each of the voltages received by the rod electrodes in the quadrupole rod assembly.

Figure 2B:
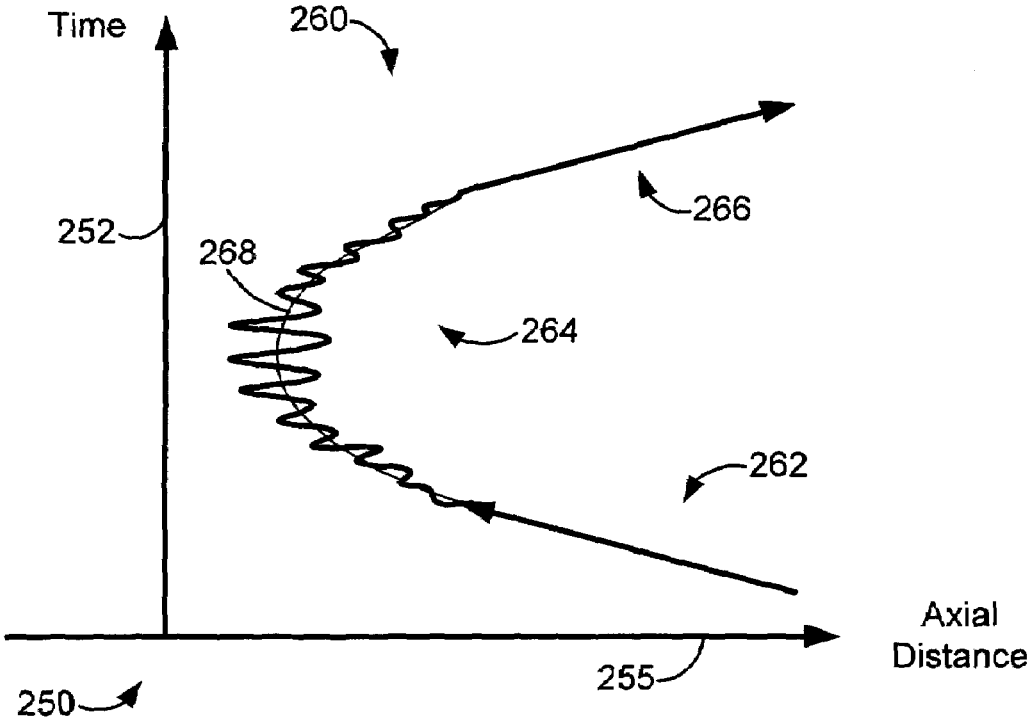

FIG. 2B shows a coordinate system 250 to schematically illustrate a trajectory 260 describing a typical movement of the positive 210 or negative 215 ions when they approach the ion lens 220. In the coordinate system 250, a vertical axis 252 represents time and a horizontal axis 255 represents a corresponding axial distance of the ions from the ion lens 220 along the axis 234. The trajectory 260 illustrates ion movements in the absence of a background gas. If background gas molecules are present, the ion trajectories become different. For example, small gas molecules may provide a damping for a large ion's movement; or the ion's trajectory may become stochastic due to random collisions between the ion and the gas molecules.

The trajectory 260 includes three trajectory portions 262, 264 and 266. In the first trajectory portion 262, the ions move only in the multipole potential that radially confines the ions close to the axis 234, where the multipole potential defines substantially zero electric fields. Thus along the axis 234, the ions may move axially with a substantially uniform speed and approach the aperture 225 in the ion lens 220. The substantially uniform speed is represented in the trajectory 260 by a substantially uniform slope of the first trajectory portion 262.

In the second trajectory portion 264, the ions experience electric fields that are generated by the oscillating electric potential due to the RF voltage applied to the ion lens 220. The oscillating potential defines electric fields that force the ions to oscillate according to the frequency of the applied RF voltage. These oscillations of the ions are represented by fluctuations in the second trajectory portion 264. The fluctuations can be described as fast oscillations about a center corresponding to an average location of the ion during a few oscillations. This center moves more slowly and smoothly than the ion itself, as schematically illustrated by a center trajectory 268 in FIG. 2B.

The center trajectory 268 can be determined using an adiabatic approximation—a detailed description of the approximation (including limits of its applicability) can be found in "Inhomogeneous RF fields: A versatile tool for the study of processes with slow ions" by Dieter Gerlich in *State-selected and stat-to-state ion-molecule reaction dynamics, Part* 1. *Experiment*, Edited by Check-Yiu NG and Michael Baer, Advances in Chemical Physics Series, Vol. LXXXII, ® 1992 John Wiley & Sons, Inc. The adiabatic approximation describes separately the fast oscillations in the second trajectory portion 264 and the much slower motion of the oscillations' center along the center trajectory 268. For a particular ion, the center trajectory 268 can be described as if the ion moved in a pseudopotential $V_P$ (which is also referred to as the effective potential or the quasipotential) that is independent of time and the sign of the charge of the ion. The pseudopotential $V_P$, however, depends on the ion's mass m, a charge number ("Z") that specifies the net number and sign of the ion's charge ("Q=Z e"), and characteristics of the oscillating electric potential that causes the fast oscillations. For an oscillating electric potential that generates an electric field E(r,t) oscillating with an angular frequency ("Ω") and an amplitude E(r) at a location r as $$E(r,t)=E(r)\cos(\Omega t),$$

the pseudopotential $V_P(r)$ is given at the location r as $$V_P(r)=ZeE(r)^2/(4m\Omega^2) \quad \text{(Eq. 1).}$$

As the ion approaches the aperture 225 along the axis 234, the lens 220 generates an increasing electric field amplitude E(r) and, according to Eq. 1, an increasing magnitude of the pseudopotential $V_P$. The gradient of the pseudopotential points away from the lens 220 and the aperture 225 defined by the lens 220, because the sign of the pseudopotential is the same as the sign of the ion's charge. This gradient determines the direction and strength of an average force experienced by the ion. Subject to this average force, the ion turns back before reaching the aperture 225, as illustrated by the center trajectory 268. Thus in the channel about the axis 234, the ion is axially confined by the oscillating electric potential generated by the RF voltage applied to the lens 220.

Because the pseudopotential $V_P$ has the same sign as the charge number Z of the ion, it can confine both the positive 210 and negative 215 ions. The pseudopotential $V_P$ depends on the mass m of the ion and the ion's charge (Q=Z e). According to this dependence, the same oscillating electric potential may confine some ions while allowing other ions to pass.

Figure 2C:
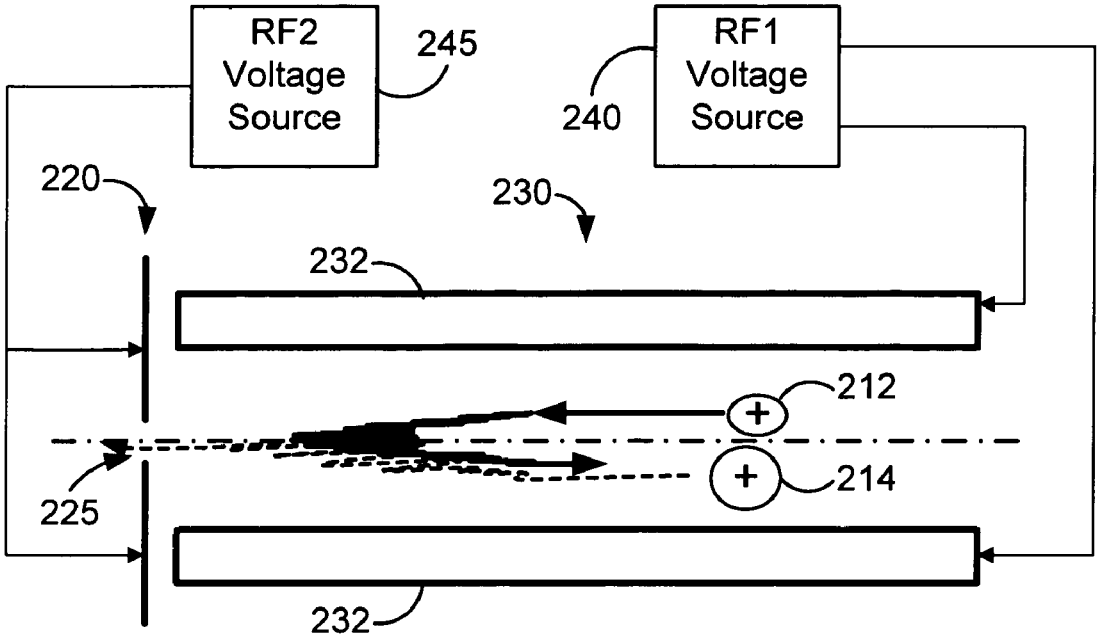

FIG. 2C illustrates an example in which a smaller ion 212 and a larger ion 214 approach the ion lens 220 in the end section 230. The ions 212 and 214 have the same positive charge and similar kinetic energies, but the larger ion 214 has a larger mass than the smaller ion 212. The ions 212 and 214 are confined radially close to the axis 234 by a 2D multipole field generated by RF voltages applied to the multipole rod electrodes 232 by the RF voltage source 240. The RF voltage source 245 applies RF voltages to the ion lens 220 to generate an oscillating electric field that confines the smaller ion 212 but allows the larger ion 214 to leave the end section 230 and pass through the aperture 225 of the lens 220.

Figure 2D:
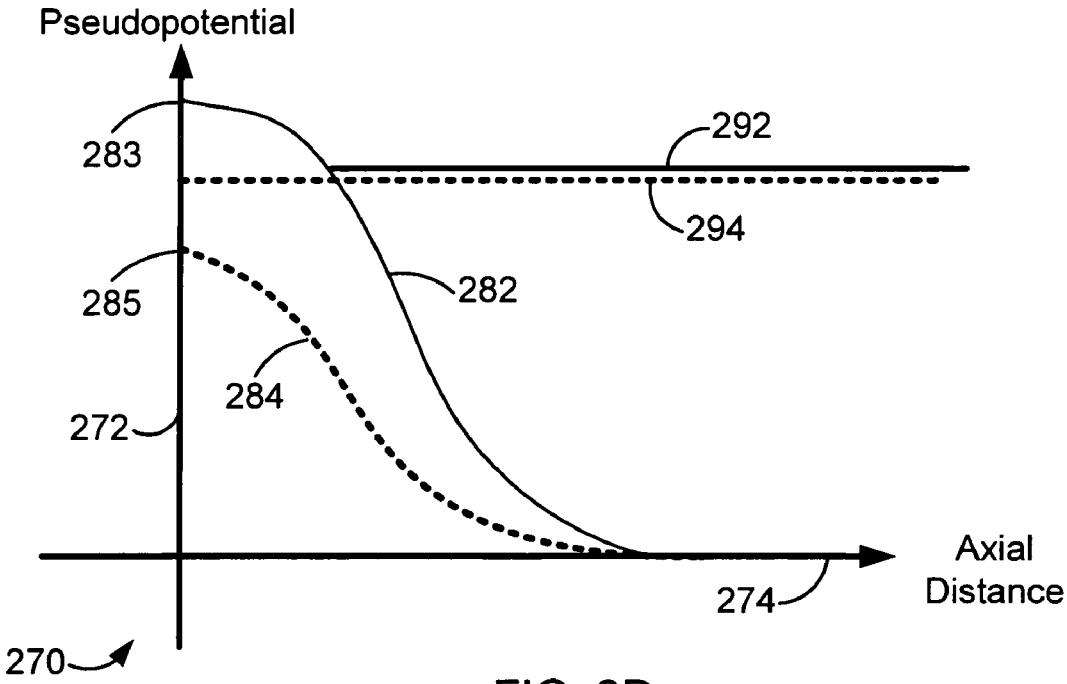

FIG. 2D schematically illustrates pseudopotentials for the example shown in FIG. 2C. In a coordinate system 270, pseudopotential values are represented on a vertical axis 272, and an axial distance from the lens 220 along the axis 234 is represented on a horizontal axis 274. The represented pseudopotentials are defined by the same oscillating electric potential generated by the ion lens 220.

The oscillating electric potential defines a first pseudopotential 282 for the small ion 212 and a second pseudopotential 284 for the large ion 214. Because these pseudopotentials are defined by the same oscillating electric potential, the electric field amplitude E(r) is the same for both (see Eq. 1). Thus, the first 282 and second 284 pseudopotentials have similar shapes as a function of the axial distance ("r") from the lens 220. The pseudopotentials 282 and 284 have substantially zero values at large distances from the lens 220, and increase as the corresponding ions approach the lens 220. Each of he increasing pseudopotentials 282 and 284 defines a barrier as the maximum value of the corresponding pseudopotential along the axis 234 of the ion trap. The first pseudopotential 282 defines a first barrier 283, which is higher than a second barrier 285 defined by the second pseudopotential 284. The difference between the barriers 283 and 285 is due to the mass-to-charge difference between the smaller ion 212 the larger ion 214. For other ions with different mass and/or charge values, the pseudopotential barriers can be determined by finding the maximum value of Eq. 1 for locations along the axis 234.

The smaller ion 212 and the larger ion 214 have average energy levels 292 and 294, respectively. The average energy levels can be defined by averaging the ions' energy during one period of the oscillating potential. In the example, the average energy levels 292 and 294 have similar values. For the smaller ion 212, the average energy level 292 is below the corresponding barrier 283. Accordingly, the smaller ion 212 is axially confined by the oscillating electric potential. After reaching the point where the average energy level 292 is substantially equal to the local value of the pseudopotential 282, the smaller ion 212 turns away from the lens 220. For the larger ion 214, however, the average energy level 294 is above the corresponding barrier 285. Accordingly, the larger ion 214 is not confined axially by the oscillating electric potential, and can leave the end section 230 through the aperture 225.

The above described adiabatic approximation and the corresponding pseudopotentials have limits of applicability. For example, the adiabatic approximation can be used only if the electric field amplitude |E(r)| is substantially larger than its variation measured by the electric field's gradient ("∇E") times a characteristic amplitude of the fast oscillations. That is, if the electric field changes too much between extremes of a single oscillation of an ion, the adiabatic description is invalid and the pseudopotential cannot be used to describe the ion's motion.

Based on this condition, a dimensionless adiabacity parameter ζ can be defined for an ion with mass m and charge Z in an electric field oscillating with a single frequency Ω as $$=2Z|\nabla E|/m\Omega^{2.}$$

Typically, the adiabatic approximation is valid if the adiabacity parameter ζ is less than about 0.3. The adiabacity parameter ζ is inversely proportional to the mass-to-charge ratio m/Z of the ion. That is, the larger the mass-to-charge ratio of the ion, the more likely it is that the adiabatic approximation is valid.

Near the axial pseudo potential barriers in a quadrupole trap, the trapped ions may experience undesired linear, non-linear, or parametric excitations, and can escape from the trap. Such excitations may be avoided if the ions are trapped with appropriately chosen RF electric fields.

Figure 3:
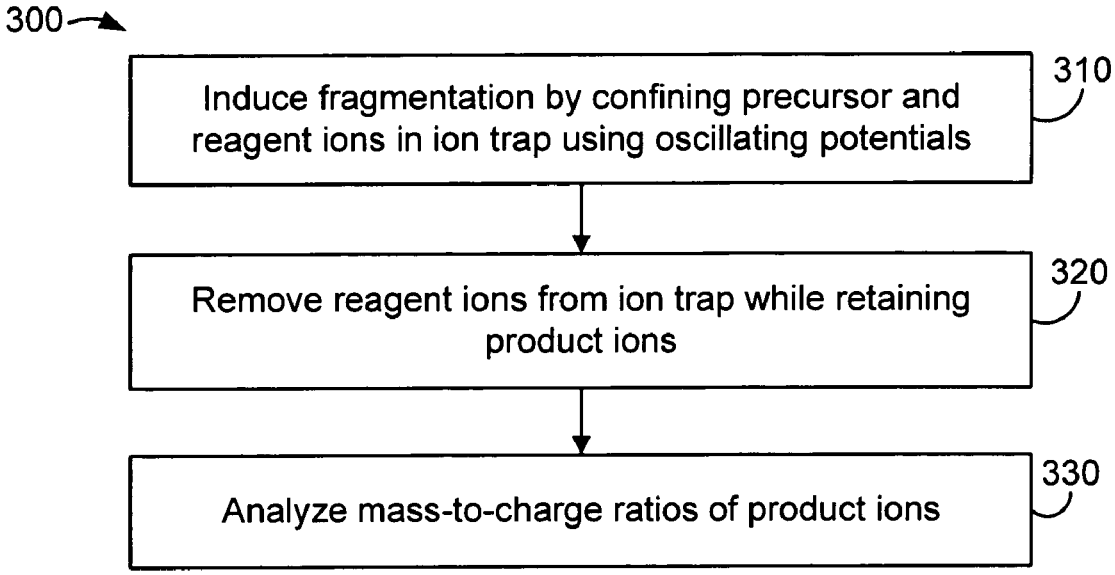
FIG. 3 is a schematic flow diagram illustrating a method for mass spectrometry according to one aspect of the invention.

FIG. 3 illustrates a method 300 for performing mass analysis according to the techniques described above. The method 300 can be performed by a system including a 2D multipole ion trap in which positive and negative ions can be confined radially and axially by separate oscillating electric potentials as discussed above with reference to FIGS. 1–2D. For example, the system can include the system 100 (FIG. 1) in which an RF voltage can be applied to the front lens 121 or the back lens 128 to axially confine both positive and negative ions in the ion trap 120. Alternatively, the method 300 can be performed using segmented traps discussed below with reference to FIGS. 6 and 7.

The system induces fragmentation of precursor ions into product ions by confining the precursor ions and reagent ions in the multipole ion trap radially and axially with separate oscillating electric potentials (step 310). The precursor ions can be positive ions and the reagent ions can be negative ions, or vice versa. The precursor and reagent ions are introduced in the same portion of a channel defined by the multipole ion trap, for example, as discussed below with reference to FIGS. 4–5F. In the channel, positive and negative ions are confined both radially and axially by oscillating electric potentials.

Being confined in the same portion of the channel, the precursor and reagent ions interact with each other and charge may be transferred from the reagent ions to the precursor ions. The charge transfer may induce charge reduction of a multiply charged precursor ion or even a charge reversal of the precursor ions. The charge transfer may have an energy that dissociates the precursor ions into two or more fragments.

Typically when CAD is used alone in ion traps, only the precursor ions are activated to fragment them into product ions, and the generated product ions are not activated to be further fragmented. In charge transfer induced reactions, however, the reagent ions may also interact with the fragments of the precursor ions to yield further fragmentation or other product.

In alternative implementations, the ion-ion interactions between the precursor and reagent ions can be used for other purposes than fragmentation. For example, interaction with reagent ions can be used for charge reduction in a mixture of precursor ions that have the same mass but different multiple charged states. The charge reduction can provide a suitable number of desired charge states of the precursor ions. The reagent ions can also be used to reduce charge of multiply charged product ions generated, for example, from some highly charged precursor species. The charge reduction of the product ions can simplify the mass analysis and the interpretation of the resulting product ion mass spectrum. Instead of both positive and negative ions, only positive or only negative ions can also be radially and axially confined and manipulated in the ion trap by oscillating electric potentials.

The system removes the reagent ions from the ion trap while retaining the product ions (step 320). To retain positive product ions and remove negative reagent ions, a negative DC bias can be applied to the section including the ions. When they are exposed to the negative DC bias, negative reagent ions become axially unstable, while the positive product ions become axially more stable. To retain negative product ions and remove positive reagent ions, a positive DC bias can be applied to the same section. Alternatively, the reagent ions can be removed by resonance ejection or destabilized radially in the ion trap.

The system analyzes the product ions according to their mass-to-charge ratios (step 330). In one implementation, the multipole ion trap selectively ejects the product ions based on their mass-to-charge ratios. The system detects the ejected product ions using one or more particle multipliers, and determines their mass-to-charge spectra. In alternative implementations, the ejected product ions can be guided to a mass analyzer, such as a time of flight analyzer, a magnetic, electromagnetic, ICR or quadrupole ion trap analyzer or any other mass analyzer that can determine the mass-to-charge ratios of the product ions. The mass-to-charge ratios of the product ions can be used to reconstruct the structure of the precursor ions.

In alternative implementations, the reagent ions, the precursor ions or the product ions can be further manipulated in the ion trap. For example before analyzing the product ions (step 330), some of the product ions may be ejected from the ion trap.

Figure 4:
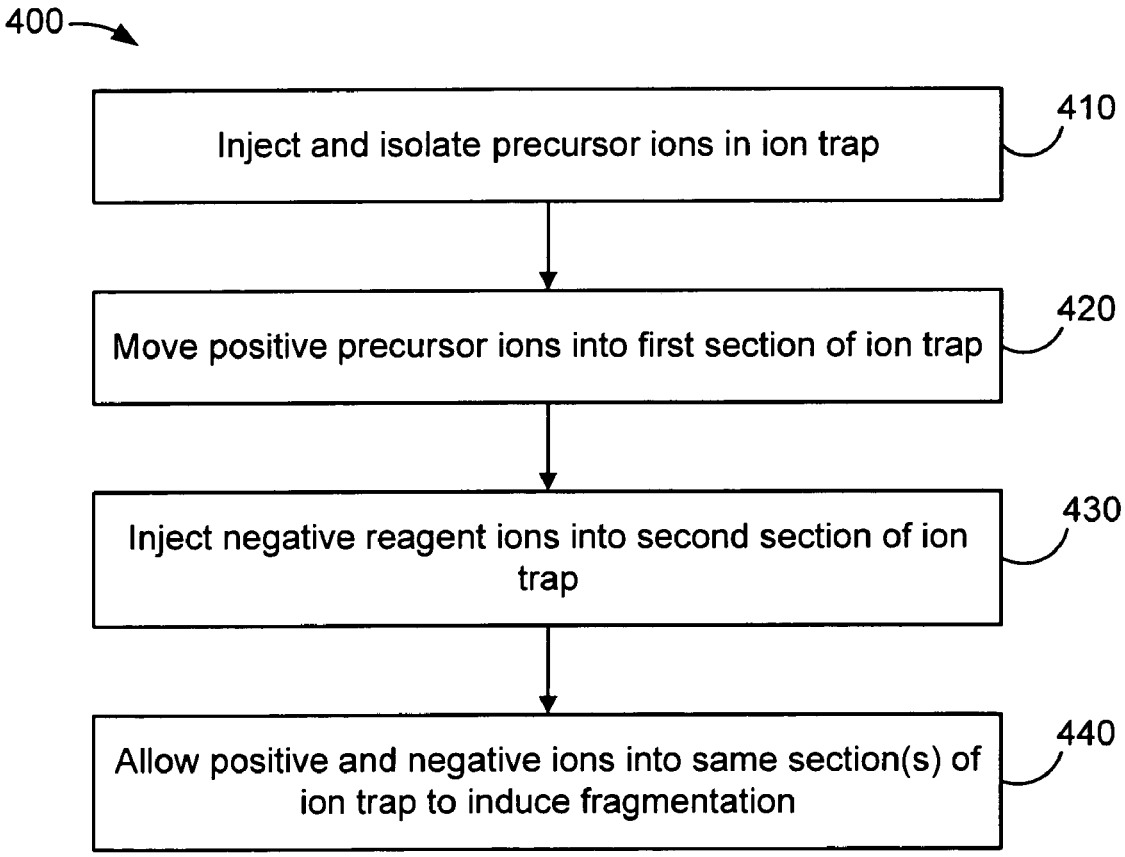
FIG. 4 is a schematic flow diagram illustrating a method for inducing ion-ion reactions.

FIG. 4 illustrates a method 400 for inducing fragmentation of precursor ions using reagent ions. The method 400 can be performed by a system, such as the system 100 (FIG. 1), that includes a segmented multipole ion trap with two or more sections in which multipole rods define an ion channel to trap or guide ions.

The system injects and isolates precursor ions in the multipole ion trap (step 410). To isolate positive precursor ions with particular mass-to-charge ratios, positive ions are generated from a sample and injected into the ion channel of the ion trap. Next, the ion trap ejects sample ions that have mass-to charge ratios other than the mass-to-charge ratios of the chosen precursor ions using, for example, resonance ejection. Thus, only the desired precursor ions remain trapped in the ion trap. Optionally, the ion trap can receive the sample ions and eject some of the non-precursor ions simultaneously.

The system moves the positive precursor ions into a first section of the multipole ion trap (step 420). To do so, the system can apply a negative DC bias to multipole rods in the first section and substantially zero or smaller negative DC biases to other sections.

The system injects negative reagent ions into a second section of the multipole ion trap (step 430). The second section is different from the first section in which the positive precursor ions are trapped. The positive ions in the first section are separated from the negative ions in the second section by electrostatic potential barriers generated by negative and positive DC biases that are applied to the first and second sections, respectively. Alternatively, the first and second sections can be separated by a third section generating an oscillating electric potential that defines pseudopotentials axially confining and separating both the positive and the negative ions in the channel of the ion trap.

The system allows the positive precursor ions and the negative reagent ions to move into the same section or sections of the multipole ion trap to induce fragmentation of the precursor ions (step 440). If DC biases separated the ions in the first section from the ions in the second section, the system can remove the DC biases and allow the positive and negative ions to move in both of the first and second sections. Without DC biases, the positive and negative ions can be trapped simultaneously in the ion trap by oscillating electric potentials that axially confine ions in the ion channel of the ion trap, as discussed above with reference to FIGS. 1–2D. If the first and second sections are separated by a third section in which an oscillating electric potential axially confines both the precursor and the reagent ions, the system can alter or turn off the oscillating potential such that the precursor ions, the reagent ions, or both can traverse through the third section. Being confined in the same section or sections of the ion trap, the positive precursor ions and the negative reagent ions can interact such that charge transfer and collisions may fragment the precursor ions.

FIGS. 5A–5E schematically illustrate an exemplary implementation of the method 400 using negative reagent ions and axially confining oscillating potentials. In the example, a 2D multipole ion trap 500 defines an ion channel about an axis 502. The trap 500 includes a front lens 503, a front section 504, a center section 505, a back section 506, and a back lens 507. Each of the sections 504–506 includes a corresponding set of multipole rods that receive RF voltages (e.g., with a frequency of about 1.2 MHz) to generate an oscillating multipole potential that radially confines ions in the ion channel about the axis 502. In addition, the lenses 503 and 507 can also receive RF voltages to axially confine ions in the ion channel. In the ion trap 500, DC biases can be applied to any of the components 503–507. In the ion trap 500, a 0.001 torr of Helium gas provides dissipation or damping for the ions.

Figure 5A:
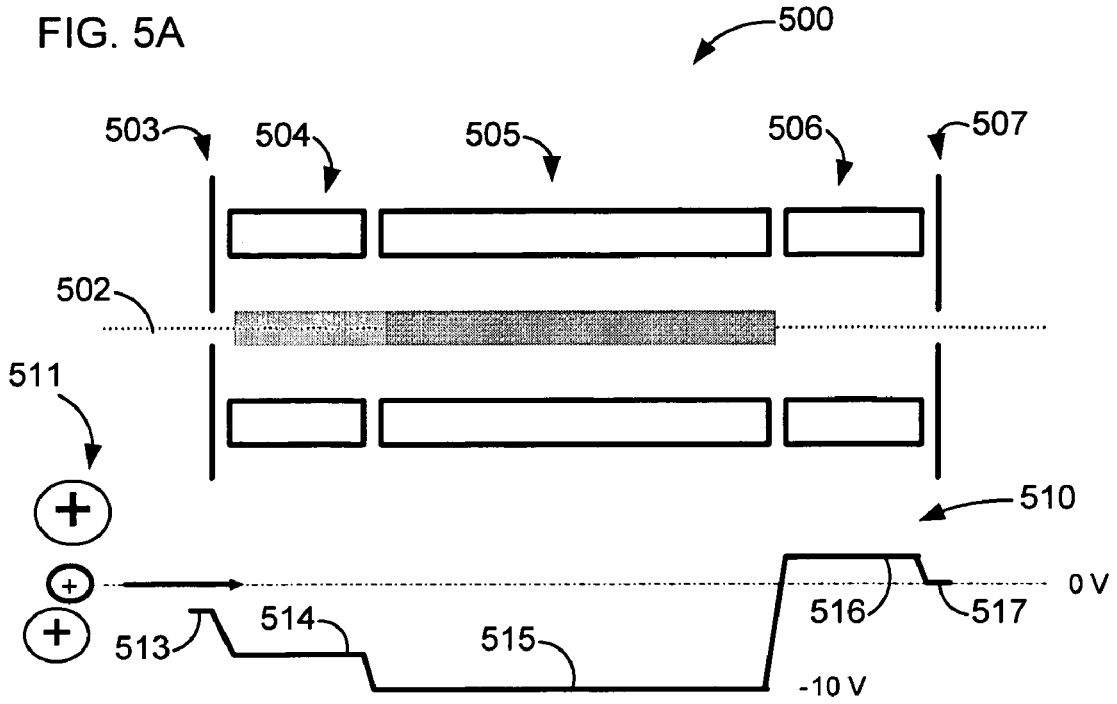
FIGS. 5A–5F are schematic diagrams illustrating an exemplary implementation of inducing ion-ion reactions in a segmented multipole trap.

In FIG. 5A, positive sample ions 511 are injected into the ion trap 500. The sample ions 511 include ions with different masses and single or multiple positive charges. The sample ions 511 can be generated by ESI or any other ionization technique.

The sample ions are injected into the ion trap through an aperture in the front lens 503, and are accumulated in the center section 505. During injection, different DC biases are applied to different components of the ion trap 500, as illustrated by a schematic diagram 510. The front lens 503, the front section 504 and the center section 505 receive negative DC biases 513, 514 and 515, respectively. The negative biases 513, 514 and 515 have progressively larger values, such as about −3 Volts, −6 Volts and −10 Volts, respectively, to generate electrostatic fields that impel the positive sample ions 511 towards the center section 505. The back section 506 receives a positive DC bias 516, such as about +3 Volts, to generate an electrostatic field that prevents the sample ions 511 from escaping the center section through the back lens 507, which receives a substantially zero DC bias 517, e.g., having a value less than about 30 mV.

Figure 5B:
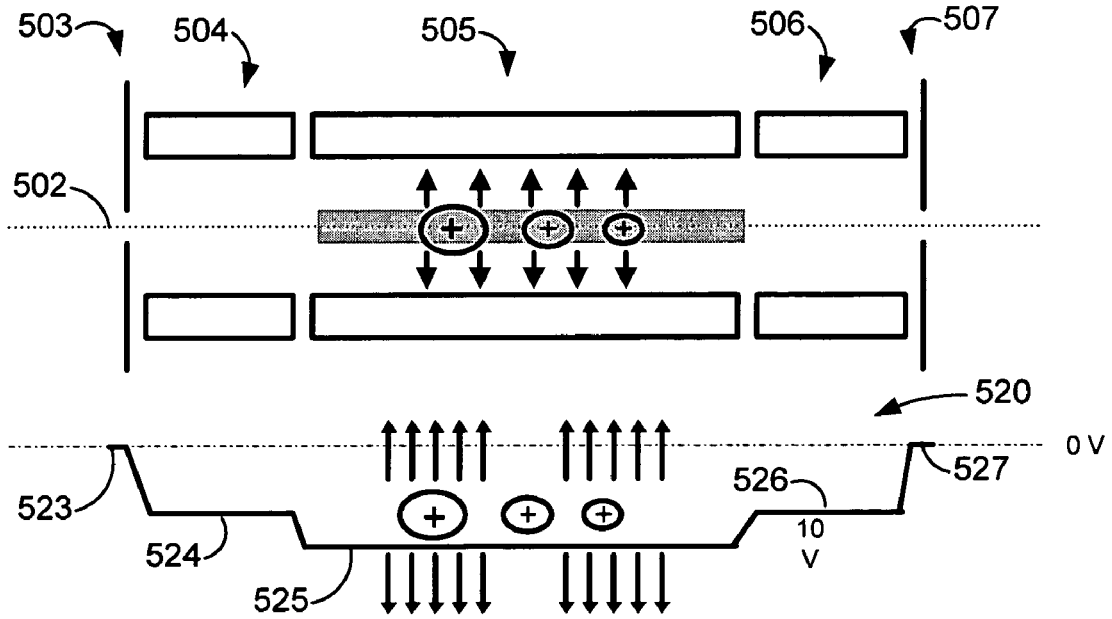

FIG. 5B illustrates the isolation of precursor ions from the sample ions 511 trapped in the center section 505 of the ion trap 500. An AC voltage is applied to the multipole rods in the center section 505 in addition to the RF voltages that generate the multipole fields. The AC voltage generates electric fields that cause the trap to eject ions that have different mass-to-charge ratios than the selected precursor ions, leaving only the precursor ions in the trap 500.

A schematic diagram 520 illustrates DC biases applied to different components of the trap 500 during the isolation. The front lens 503 and the back lens 507 have substantially zero DC biases 523 and 527, respectively. The center section 505 has a negative DC bias 525, such as about −10 V. The front section 504 and the back section 506 have negative DC biases 524 and 526, respectively, whose value is smaller than the bias 525 to generate electrostatic fields that axially confine the positive ions in the center section 505.

Figure 5C:
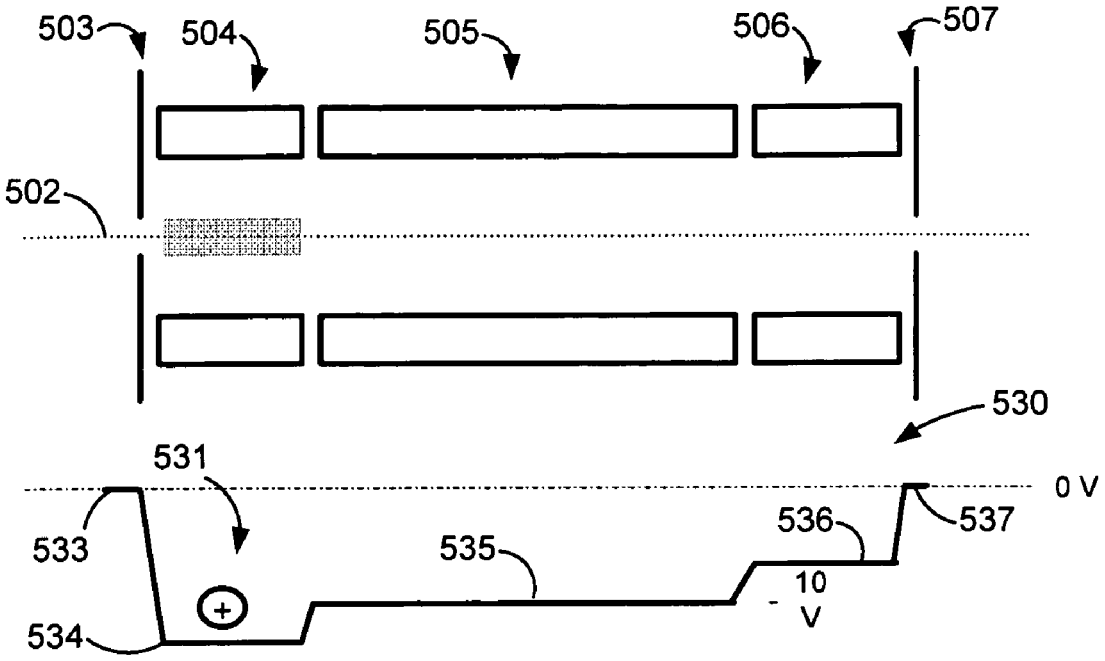

FIG. 5C illustrates the movement of the precursor ions 531 from the center section 505, in which they have been isolated, to the front section 504. As illustrated by a schematic diagram 530, the center section 505 has a DC bias 535 of about −10 V. A DC bias 534 having a larger negative value than the DC bias 535 of the center section 505 is applied to the front section 504, causing the positive precursor ions 531 to move from the center section 505 into the front section 504. For example, the DC bias 534 can have a value of about −13V. Thus, an electrostatic field is generated that moves the positive precursor ions 531 from the center section 505 to the front section 504. The front lens 503 has a substantially zero DC bias 533 to generate an electrostatic field that prevents the positive precursor ions from escaping from the front section 504 through the front lens 503. The back section 506 and the back lens 507 have a negative bias 536 and a substantially zero bias 537, respectively, to generate electrostatic fields that move the positive precursor ions towards the front section 504 and prevent their escape through the back lens 507.

Figure 5D:
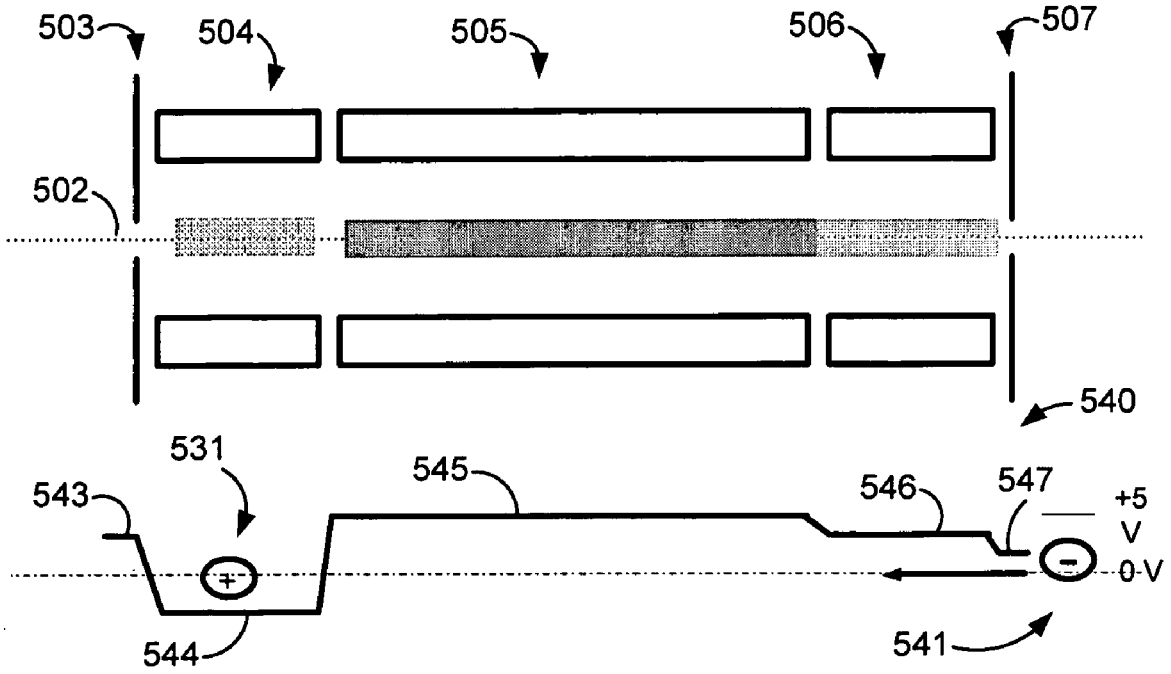

FIG. 5D illustrates the injection of negative reagent ions 541 into the center section 505 while the positive precursor ions 531 are held in the front section 504 of the ion trap 500. The reagent ions 541 can be generated by chemical ionization or any other suitable ionization technique. The negative reagent ions are injected into the ion trap through an aperture in the back lens 507, and are accumulated in the center section 505. During injection, different DC biases are applied to different components of the ion trap 500, as illustrated by a schematic diagram 540. The back lens 507, the back section 506 and the center section 505 receive positive DC biases 547, 546 and 545, respectively. The positive biases 547, 546 and 545 have larger and larger values, such as about +1 V, +3 V and +5 V, respectively, to generate electrostatic fields that move the negative reagent ions 541 towards the center section 505. In the center section 505, the reagent ions collide with the background gas and become trapped.

The front section 504 receives a negative DC bias 544, such as about −3 V, to trap the positive precursor ions 531 and separate them from the negative reagent ions 541 in the center section 505. The front lens 503 receives a positive DC bias 543, such as about 3V, to generate an electrostatic field that prevents the precursor ions 531 from escaping from the front section 504 through the aperture in the front lens 503.

Figure 5E:
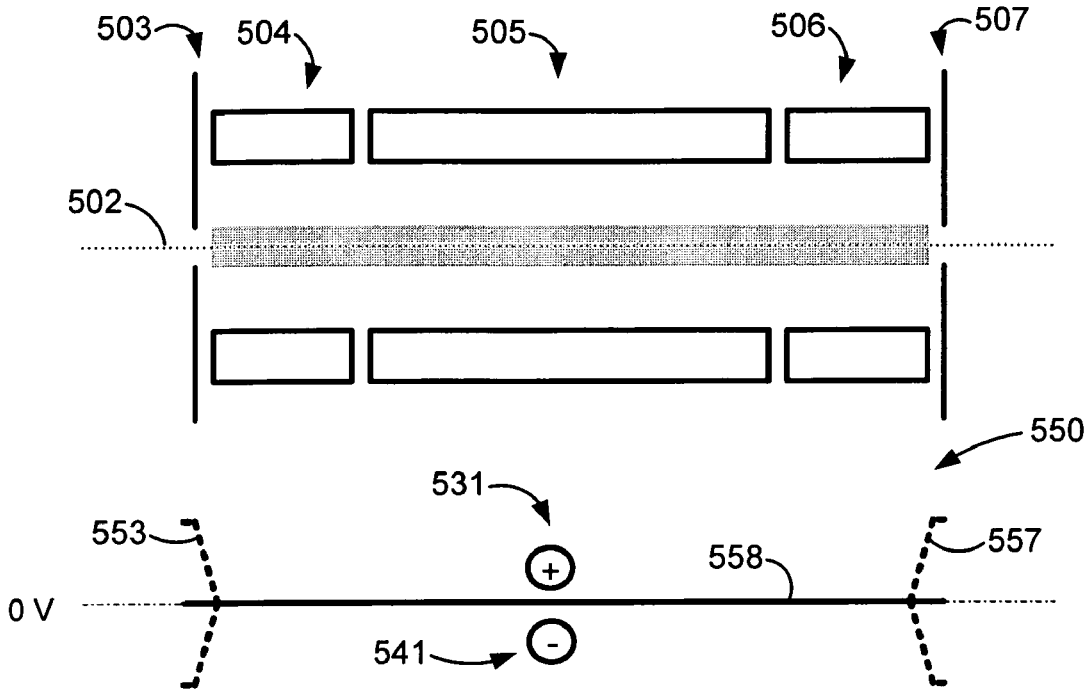

FIG. 5E illustrates the mixing of the positive precursor ions 531 and the negative reagent ions 541 along the axis 502 in all the sections 504, 505 and 506 of the multipole ion trap 500. As illustrated in a schematic diagram 550, each of the sections 504, 505 and 506 have substantially identical DC biases, such as a substantially zero DC bias 558, to allow the movement of the positive and negative ions along the axis 502. The same DC bias 558 is also applied to the front lens 503 and the back lens 507.

Near the lenses 503 and 507, both the positive precursor ions 531 and the negative reagent ions 541 are axially confined along the axis 502 by oscillating electric potentials 553 and 557 generated by RF voltages applied to the front lens 503 and the back lens 507, respectively. For example, both the front lens 503 and the back lens 507 can receive an RF voltage with an amplitude of about 150 V and a frequency of about 600 kHz, which is about half of the RF frequency applied to the rod electrodes. Thus the precursor ions 531 and the reagent ions 541 are confined in the same volume and their interactions may induce charge transfers and fragmentations of the precursor ions. The charged fragments (i.e., the product ions) are confined axially by the same oscillating electric potentials 553 and 557 as the precursor and reagent ions.

Figure 5F:
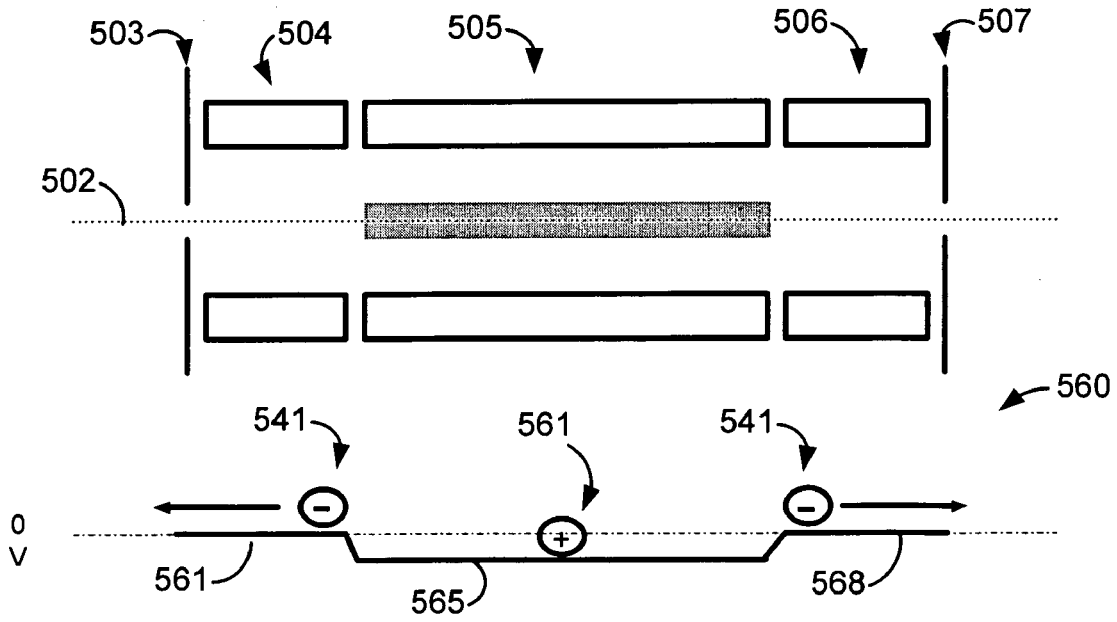

FIG. 5F illustrates the removal of the negative reagent ions 541 from the ion trap 500 while retaining the positive product ions 561. As schematically illustrated in a diagram 560, the negative reagent ions 241 can be removed from the trap 500 by applying a negative DC bias 565 to the center section 505 and substantially zero DC biases 561 and 568 to the front section 503 and the back section 506, respectively. The DC biases 561, 565 and 568 generate electric fields that allow the negative reagent ions 541 to exit towards the front lens 503 and the back lens 507, and confine the positive product ions 561 in the center section 505. To remove the reagent ions through the lenses 503 and 507, no substantial DC bias or RF field is applied to the lenses. After removing the reagent ions, the product ions can be analyzed, for example, by selectively ejecting product ions with different mass-to-charge ratios. Alternatively, the product ions can be further manipulated in the ion trap.

Figure 6:
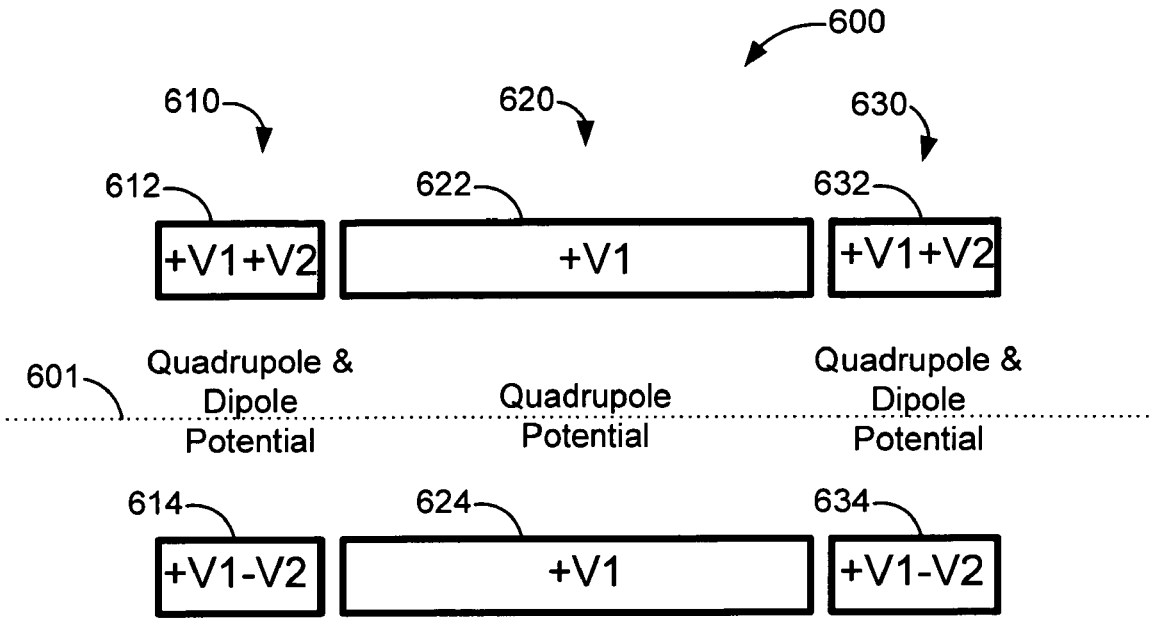
FIG. 6 is a schematic diagram illustrating an alternative embodiment of apparatus to induce ion-ion interactions.

FIG. 6 schematically illustrates an alternative embodiment in which positive and negative ions can be both radially and axially confined using oscillating electric potentials in a multipole ion trap 600. The multipole ion trap 600 includes a front section 610, a center section 620 and a back section 630 that define a channel about an axis 601. Each of the sections 610, 620 and 630 includes a multipole rod assembly, such as a quadrupole rod assembly that includes two pairs of opposing rod electrodes. Alternatively, the rod assemblies can be hexapole, octapole or larger assemblies including three, four or more pairs of opposing rod electrodes. In each of the sections 610, 620 and 630, FIG. 6 schematically illustrates one pair of opposing rod electrodes, that is, rod electrodes 612 and 614 in the front section 610, rod electrodes 622 and 624 in the center section 620, and rod electrodes 632 and 634 in the back section 630.

In the center section 620, the opposing rod electrodes 622 and 624 receive RF voltages V1 in the same phase to generate, in combination with the other rod electrodes in the center section 620, an oscillating multipole potential, such as a quadrupole potential. The generated oscillating multipole potential radially confines ions close to the axis 601, where the multipole potential defines substantially zero electric fields.

In the front section 610, the opposing rod electrodes 612 and 614 receive the same RF voltages V1 as the rod electrodes 622 and 624 in the center section 620 to generate, in combination with the other rod electrodes in the front section 610, an oscillating multipole potential that radially confines ions close to the axis 601. In addition to the RF voltages V1, the rod electrodes 612 and 614 also receive another RF voltage V2 that have substantially opposite phases in the opposing rod electrodes 612 and 614. Thus the rod electrodes 612 and 614 also generate an oscillating dipole potential in the front section 610. The dipole potential defines substantially non-zero electric fields at the axis 601 in the front section 610. Thus, the oscillating dipole potential can axially confine both positive and negative ions trapped in the center section 620. Other opposing rod electrodes in the front section 610 can also generate oscillating dipole potentials. For different opposing rods in the front section 610, the dipole potentials can have the same or different oscillation frequencies, and for the same frequency, can be in phase or out of phase relative to each other.

In the back section 630, the opposing rod electrodes 632 and 634 receive the same RF voltages as the opposing rods 612 and 614 in the front section 610. Thus, the opposing rods 632 and 634 in the back section 630 also generate an oscillating multipole potential to confine the ions radially close to the axis 601, and an oscillating dipole potential to confine the ions axially in the center section 620. Because the oscillating electric potentials can confine both positive and negative ions, the ion trap 600 can be operated to induce ion-ion interactions and corresponding fragmentation in the center section 620.

Figure 7:
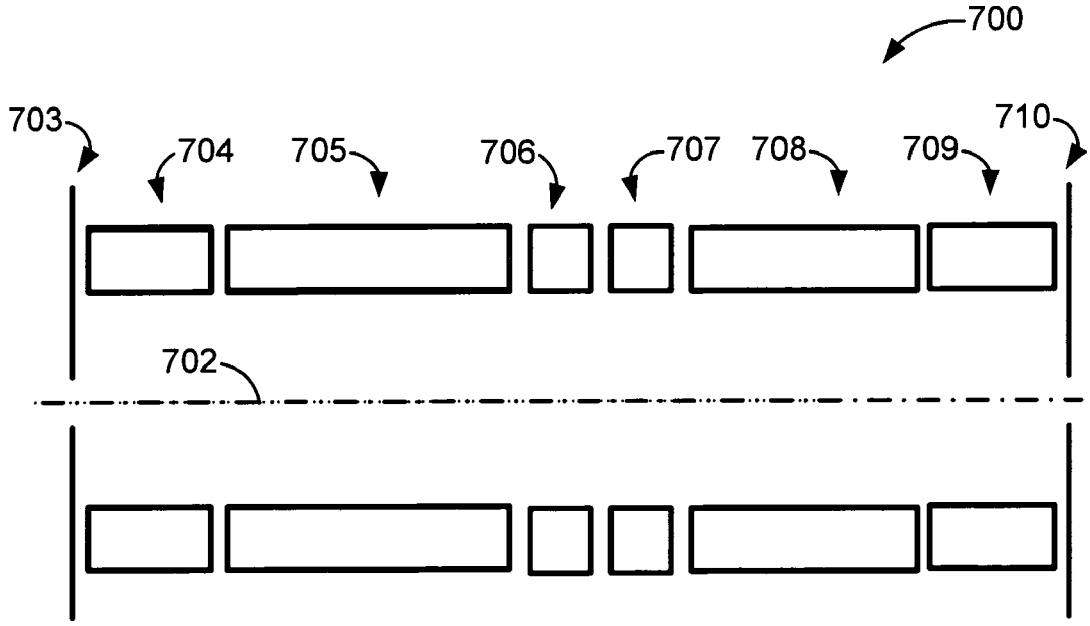
FIG. 7 is a schematic diagram illustrating yet another alternative embodiment of apparatus to induce ion-ion interactions.

FIG. 7 schematically illustrates still another embodiment in which positive and negative ions can be both radially and axially confined using oscillating electric potentials in a multipole ion trap 700. The multipole ion trap 700 includes a front lens 703, sections 704–709, and a back lens 710. Each of the sections 704–709 includes a multipole rod assembly, such as a quadrupole or larger assembly, to trap or guide ions in an ion channel about an axis 702.

The multipole ion trap 700 can be operated to separately receive a first and a second set of ions, and later induce interactions between ions of the two sets by confining them into the same section or sections of the ion trap 700. For example, the first set can include precursor ions and the second set can include reagent ions. The first set of ions can be received through the front lens 703 and stored in the section 705, and the second set of ions can be received through the back lens 710 and stored in the section 708.

The ions in the first set can be separated from the ions in the second set by oscillating electric potentials generated by the multipole rods in the sections 706 and 707. For example, different oscillating dipole potentials can be generated in the sections 706 and 707 to axially confine ions in the first set and the second set, respectively. Thus ions in the section 705 can be manipulated separately from ions in the section 708. For example, precursor ions can be isolated from the first set in the section 705, and reagent ions can be isolated from the second set in the section 708.

The oscillating electric potentials can be adjusted in the sections 706 and 707 to allow ions pass from the section 705 to section 708, and vice versa. For example, instead of dipole potentials, quadrupole potentials can be generated in the sections 706 and 707 to guide the ions between the sections 705 and 708. Positive and negative ions can be axially confined near the ends of the ion trap 700 by oscillating electric potentials generated by the front lens 703 and the back lens 710, or dipole potentials generated in the sections 704 and 709.

In one implementation, a segmented trap, such as the ion trap 700 illustrated in FIG. 7, ion-ion reactions are occurring in a first segment. A weak pseudo potential barrier is created to partition the precursor and reagent ions from a second segment that has a lower axis DC bias potential. As the ion-ion reaction creates product ions in the first segment, some of the product ions may have sufficiently large mass-to-charge ratios and thermal kinetic energy to pass through the weak pseudo potential barrier and penetrate the second segment where they are dampened by collisions and may be captured. Thus, these product ions are removed from the first section and are no longer exposed to further reactions with reagent ions. Such removal of the product ions may reduce neutralization and subsequent loss of product ions.

Method steps of the invention can be performed by one or more programmable processors executing a computer program to perform functions of the invention by operating on input data and generating output. Method steps can also be performed by, and apparatus of the invention can be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in special purpose logic circuitry.

To provide for interaction with a user, the invention can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

A number of embodiments of the invention have been described. Nevertheless, it will be understood that various modifications may be made without departing from the spirit and scope of the invention. For example, the steps of the described methods can be performed in a different order and still achieve desirable results. The described techniques can be applied to other ion traps or guides, such as curved axis ion guides that define a curved ion channel to trap or guide ions, planar RF ion guides (planar multipoles) and RF cylindrical ion pipes. Instead of segmented ion traps, the described techniques can also be implemented using multiple separate ion traps.

What is claimed is:

1. A method of fragmenting precursor ions, comprising:

introducing precursor ions into an ion channel of a two-dimensional ion trap;

introducing reagent ions into the ion channel, the reagent and precursor ions having opposite polarities;

simultaneously confining the precursor and reagent ions in both the axial and radial dimensions of the ion channel; and allowing the precursor ions to interact with the reagent ions to produce product ions.

2. The method of claim 1, further comprising:

stopping the interaction of the precursor ions with the reagent ions by removing the reagent ions from the ion channel.

3. The method of claim 1, wherein the step of simultaneously confining the precursor and reagent ions includes initially confining the precursor ions in a first section of the ion channel and the reagent ions in a second section of the ion channel, and creating a potential barrier between the first and second sections of the ion channel to inhibit mixing of the precursor ions and the reagent ions.

4. The method of claim 3, wherein the step of allowing the precursor ions to interact with the reagent ions includes removing the potential barrier.

5. The method of claim 1, wherein the step of simultaneously confining the precursor ions and the reagent ions includes applying a first periodic voltage to a first set of electrodes of the ion trap to radially confine the precursor ions and the reagent ions, and applying a second periodic voltage to a second set of electrodes of the ion trap to axially confine the precursor ions and the reagent ions.

6. The method of claim 2, wherein the step of stopping the interaction of the precursor ions and the reagent ions includes removing the reagent ions by applying a direct current bias to selected electrodes of the ion trap.

7. The method of claim 1, further comprising a step of removing undesired ion species from the precursor ions in the ion trap prior to allowing the precursor ions to interact with the reagent ions.

8. The method of claim 1, further comprising a step of mass analyzing the product ions.

9. The method of claim 8, wherein the step of mass analyzing the product ions is performed by mass-selectively ejecting the product ions from the ion trap.

10. A mass spectrometer system, comprising:

a precursor ion supplier configured to generate precursor ions;

a reagent ion supplier configured to generate reagent ions having a polarity opposite to that of the precursor ions;

a two-dimensional ion trap configured to receive the precursor ions and the reagent ions; and a controller, coupled to the ion trap, configured to apply a first periodic voltage to a first set of electrodes of the ion trap and to apply a second periodic voltage to a second set of electrodes of the ion trap, such that the precursor ions and the reagent ions may be simultaneously confined in both the axial and radial dimensions of an ion channel in the interior of the ion trap.

11. The mass spectrometer system of claim 10, wherein the ion trap includes a plurality of generally parallel rods, each rod being divided into at least a first and a second section, the first and second sections of the plurality of rods respectively defining first and second sections of the ion channel.

12. The mass spectrometer system of claim 11, wherein the controller is further configured to apply a direct current bias to at least one of the first and second rod sections, such that a potential barrier is created that initially confines the precursor ions to the first section of the ion channel and the reagent ions to a second section of the ion channel in order to inhibit mixing of the precursor ions and the reagent ions.

13. The mass spectrometer system of claim 12, wherein the controller is further configured to apply or remove a direct current bias to or from at least one of the first and second rod sections following the initial separate confinement of the precursor ions and the reagent ions, thereby allowing interaction of the precursor ions and the reagent ions to produce product ions.

14. The mass spectrometer system of claim 10, wherein the reagent ion supplier includes a precursor ion source for generating the precursor ions from sample molecules, and ion transfer optics for transporting the precursor ions to the ion trap.

15. The mass spectrometer system of claim 14, wherein the ion transfer optics are configured to transport only ions having a selected range of mass-to-charge ratios.

16. The mass spectrometer system of claim 10, wherein the controller is further configured to apply or remove a voltage to or from selected electrodes of the ion trap after the precursor ions have been allowed to interact with the reagent ions for a prespecified period, such that the reagent ions are removed from the ion channel.

17. The mass spectrometer system of claim 10, wherein the controller is further configured to apply or adjust voltages to selected electrodes of the ion trap in order to cause product ions formed by interaction of the precursor ions and the reagent ions to be mass-selectively ejected from the ion trap.

18. The mass spectrometer system of claim 10, wherein the controller is further configured to apply or adjust voltages to selected electrodes of the ion trap in order to cause undesired species of the precursor ions to be ejected from the trap prior to allowing the precursor ions to interact with the reagent ions.

19. The mass spectrometer system of claim 10, wherein the first set of electrodes includes a plurality of rod electrodes, and the second set of electrodes includes first and second plate ion lens electrodes located at opposite axial ends of the rod electrodes.

20. The mass spectrometer system of claim 11, wherein the first set of electrodes includes the first rod sections and the second set of electrodes includes the second rod sections.

* * * * *